US008561691B2

(12) United States Patent
Zielinska et al.

(10) Patent No.: US 8,561,691 B2
(45) Date of Patent: Oct. 22, 2013

(54) METHOD AND APPARATUS FOR EROSION CONTROL FOR USE WITH FLOW CONTROL DEVICES

(75) Inventors: Barbara J. A. Zielinska, Houston, TX (US); Andrew C. Posluszny, Friendswood, TX (US); David J. Reed, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 1265 days.

(21) Appl. No.: 11/607,461

(22) Filed: Dec. 1, 2006

(65) Prior Publication Data

US 2007/0246223 A1 Oct. 25, 2007

Related U.S. Application Data

(60) Provisional application No. 60/745,587, filed on Apr. 25, 2006.

(51) Int. Cl.
*E21B 21/00* (2006.01)

(52) U.S. Cl.
USPC ..... 166/222; 166/311

(58) Field of Classification Search
USPC ..... 166/222, 311
See application file for complete search history.

(56) References Cited

U.S. PATENT DOCUMENTS

| | | | | | |
|---|---|---|---|---|---|
| 3,066,735 | A * | 12/1962 | Zingg | ..... | 175/234 |
| 3,310,113 | A * | 3/1967 | Maness | ..... | 166/173 |
| 3,593,786 | A * | 7/1971 | Lewis | ..... | 166/222 |
| 3,850,241 | A * | 11/1974 | Hutchinson | ..... | 166/222 |
| 4,046,199 | A * | 9/1977 | Tafoya | ..... | 166/303 |
| 4,518,041 | A * | 5/1985 | Zublin | ..... | 166/312 |
| 5,060,725 | A * | 10/1991 | Buell | ..... | 166/222 |
| 5,381,862 | A * | 1/1995 | Szarka et al. | ..... | 166/212 |
| 6,427,776 | B1 * | 8/2002 | Hoffman et al. | ..... | 166/311 |
| 2005/0028977 | A1 | 2/2005 | Ward | | |
| 2005/0082060 | A1 | 4/2005 | Ward et al. | | |
| 2005/0263284 | A1 | 12/2005 | Justus | | |

FOREIGN PATENT DOCUMENTS

| | | |
|---|---|---|
| GB | 2054103 A | 2/1981 |
| GB | 2325949 A1 | 12/1998 |

OTHER PUBLICATIONS

G.N. Abramovich, "Turbulent Jets of Incompressible Fluid," MIT Press, 4 pages (1963).

J. Panda et al., NASA TM 2003-212391, "Velocity and Temperature Measurement in Supersonic Free Jets Using Spectrally Resolved Rayleigh Scattering," pp. 1-9 and Figs. 1-14 (2003).

* cited by examiner

*Primary Examiner* — Cathleen Hutchins

(74) *Attorney, Agent, or Firm* — David J. Groesbeck; Brandon S. Clark

(57) ABSTRACT

A flow control device for use in a wellbore which has a nozzle with an output to provide a jet of fluid and a structure proximate the nozzle. The structure is positioned a set distance away from the output of the nozzle, where the set distance is greater than a length of a potential core of the jet of fluid.

4 Claims, 3 Drawing Sheets

METHOD AND APPARATUS FOR EROSION CONTROL FOR USE WITH FLOW CONTROL DEVICES

CROSS-REFERENCE TO RELATED APPLICATION

This claims the benefit under 35 U.S.C. §119(e) of U.S. Provisional Application Ser. No. 60/745,587, entitled "Erosion Control in Flow Control Valves," filed Apr. 25, 2006.

TECHNICAL FIELD

The invention relates generally to erosion control to protect a downhole structure from erosion resulting from impact by a jet of fluid produced by a flow control device.

BACKGROUND

A completion system installed in a well typically includes flow control devices (such as in the form of valves) to control fluid flow in the well. The fluid flow can include production flow (to produce hydrocarbons or water from a reservoir) and/or injection flow (to inject fluid into a formation). The flow control function in a downhole valve is usually accomplished by using a flow constriction, such as in the form of a nozzle. The flow rate through the valve is regulated by changing the cross-sectional area available to fluid flow. In most downhole applications, the pressure differential across a valve can be relatively high, which can lead to creation of powerful fluid jets output from the valve.

Many valves control fluid flow in a radial direction of a wellbore. Since the available space in a wellbore is relatively limited, the distance between valves and other structures (e.g., tubing, pipe, casing, etc.) is relatively small. Consequently, a relatively powerful jet produced by a valve that impinges upon a downhole structure can cause substantial erosion of the downhole structure. For example, in the injection context, the fluid jet produced by a valve can impinge upon the casing, which can cause erosion of the casing after some amount of time. Erosion of downhole structures can also occur in the production context, where fluid flows from a wellbore annulus into a tubing or pipe.

Conventional techniques of providing erosion control include providing shrouds around a valve to protect a surrounding structure, such as the casing, from a powerful fluid jet. However, shrouds add to the complexity and expense of a tool string that contains the valve.

SUMMARY

In general, according to an embodiment, an apparatus for use in a wellbore comprises a flow control device having a nozzle with an output to provide a jet of fluid. The apparatus further includes a structure proximate the nozzle and positioned a set distance away from the output of the nozzle, where the set distance is greater than a length of the potential core of the jet of fluid.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

Figure 1:
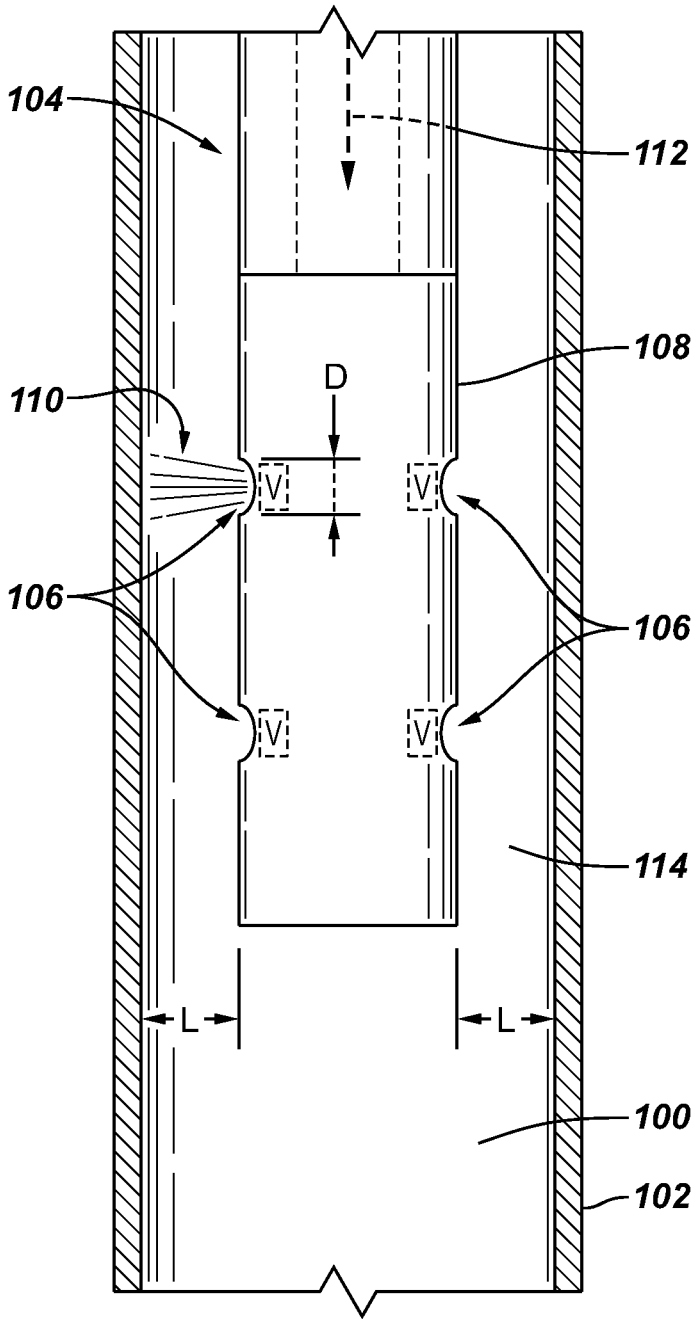
FIG. 1 illustrates a portion of an example completion system for use in a wellbore that incorporates an embodiment of the invention.

FIG. 1 shows an example completion system installed in a wellbore 100. The completion system includes a casing (or liner) 102 that lines the wall of the wellbore 100. Also depicted in FIG. 1 is a tool string 104 that is located in the wellbore 100, where the tool string 104 includes a module (e.g., a mandrel) 108 that has nozzles 106. The nozzles 106 are associated with one or more valves (e.g., sliding sleeve valves, disk valves, etc.), chokes, or other flow control devices (represented as boxes labeled with "V" in FIG. 1) that are part of the module 108. Although plural nozzles are depicted in FIG. 1, it is noted that a single nozzle can be employed in an alternative embodiment. The tool string 104 can include other downhole devices (not shown), including packers, anchors, sensors, and so forth. The tool string is configured to perform one or more downhole tasks in a well when the tool string is positioned in the wellbore.

The example tool string depicted in FIG. 1 can be an injection tool string for injecting a flow of fluid 112 from the earth surface into the wellbore 100. The injected fluid 112 exits the nozzles 106 of the module 108 into a well annulus region 114 in the wellbore 100 that is outside the module 108. The exiting fluid flows from the well annulus 114 to some other region (not shown).

As depicted in FIG. 1, the fluid exiting from each nozzle 106 produces a fluid jet 110. In many downhole injection applications, the pressure differential across a nozzle (from the input to the output) can be quite large, which can produce a relatively powerful fluid jet 110.

The fluid jet 110 can impinge upon the casing 102. If the nozzle 106 is placed too close to the casing 102, then the velocity of the fluid jet that impinges upon the casing 102 can be relatively high, which can cause erosion of the casing 102 over time.

However, in accordance with some embodiments, the nozzle 106 is set a distance L away from the wall of the casing 102. Note that FIG. 1 depicts the nozzles 106 on different sides of the module 108 being positioned the same distance (L) away from the casing wall (as would occur for a concentric placement of the module 108 inside the casing 102). However, in other scenarios, the placement of the module 108 is not concentric such that the distances between nozzles and the casing wall can be different on different sides of the module 108.

The distance L between a nozzle 106 and the casing wall is set such that the velocity of the fluid jet that impinges upon the casing 102 is reduced to provide erosion control. For a given distance L, the velocity of the fluid jet 110 that impinges upon the casing 102 is reduced depending upon the diameter D of the opening of the nozzle 106. Thus, when designing the completion system, both the nozzle diameter D and the distance L can be selected to achieve a reduction of the fluid velocity of the fluid jet that impinges upon the casing 102. The value of L can be selected to be a smaller value if the diameter D of the nozzle opening is reduced. However, reduction of the nozzle opening diameter leads to reduced flow rate. To compensate for reduced flow rate, a larger number of nozzles of the reduced diameter are provided such that the effective total area available for flow between the module 108 and the wellbore 100 can be increased, such that a target flow rate can be accomplished.

Although reference is made to diameters of nozzle openings, it is noted that nozzle openings can have non-circular shapes, in which case, the largest diameter of the nozzle opening is selected.

Although FIG. 1 depicts erosion control in the context of fluid injection from the tool string 104 out toward the wall annulus 114, it is noted that erosion is also a concern for fluid flow in the reverse direction, from the well annulus 114 into the tool string 104. For example, when producing hydrocarbons or other fluids from the surrounding reservoir, the pressure differential across the nozzle (from outside the module 108 to the inner bore of the module 108) can be relatively large such that a relatively powerful jet of fluid can be produced inside the module 108. The fluid jet can impinge upon the inner walls of the module 108, which can cause erosion of such inner walls. The inner walls of the module 108 are another example of downhole structures that are subject to erosion resulting from impact of powerful fluid jets. The distance between the nozzles and the inner walls of the module 108, along with diameters of the nozzle openings, can also be set to provide erosion control for the module inner walls.

The arrangement of the nozzles 106 of FIG. 1 provide for flows of fluids in the radial direction of the wellbore 100 (in either the injection or production context). In other implementations, the nozzles 106 can be arranged such that flows of fluids occur in other directions, such as the axial direction of the wellbore 100 or a diagonal direction. In any of these directions, powerful fluid jets may be produced by the nozzles such that erosion control for other downhole structures is desirable.

The fluid jet considered is a submerged free jet that spreads through a medium at rest. A submerged fluid jet refers to a fluid jet submerged within the same fluid (e.g., liquid jet submerged in liquid or gas jet submerged in gas). More specifically, some examples include a water jet submerged in water, a hydrocarbon jet submerged in hydrocarbon, a natural gas jet submerged in natural gas, and so forth.

Figure 2:
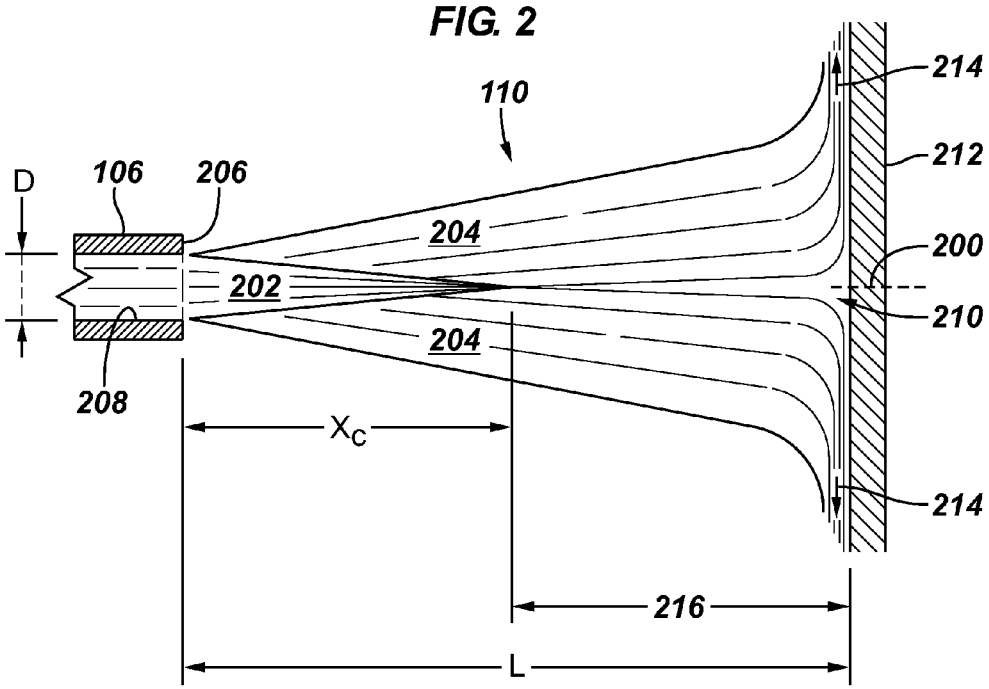
FIG. 2 illustrates a profile of a jet of fluid produced by the nozzle of a valve in the completion system.

As depicted in FIG. 2, the fluid jet 110 exiting the nozzle 106 flows generally along a direction of the center axis 200 of the nozzle 106, although the fluid jet 110 does expand in width with increasing distance from the nozzle 106. The velocity of the fluid jet 110 remains constant in a potential core 202 of the fluid jet 110. However, the potential core 202 is surrounded by a mixing layer 204, which is also part of the fluid jet 110. The mixing layer 204 of the fluid jet 110 has a turbulent fluid flow that surrounds the potential core 202, and the mixing layer 204 has a width that increases with increasing distance from the nozzle 106. By contrast, the potential core 202 has a width that decreases with increasing distance from the output end 206 of the nozzle 106, until the width becomes zero at distance $X_c$ from the output end 206 of the nozzle 106.

After a distance $X_c$ from the nozzle output end 206, the entire width of the fluid jet 110 is made up of the mixing layer 204. In other words, the potential core 202 extends the distance $X_c$ from the output end 206 of the nozzle 106 ($X_c$ defines the length of the potential core 202 of the fluid jet 110). In the region 216 of the fluid jet 110 that is downstream of the end of distance $X_c$, the average velocity of the fluid within the fluid jet 110 decreases with increasing distance from the output end 206 of the nozzle 106. Reference is made to "average velocity" of fluid in the mixing layer 204 due to the fact that the actual velocity of fluid in the mixing layer is not constant as a result of turbulent fluid flow.

Generally, the length ($X_c$) of the potential core 202 varies between four and seven nozzle diameters for incompressible submerged fluid jets. A nozzle diameter is represented by D, where D is the diameter of the inner opening 208 of the nozzle 106. For compressible submerged fluid jets, the length of the potential core 202 increases with increasing Mach number (which represents the velocity of the fluid jet expressed as a Mach number, or the speed of sound).

Generally, the velocity profile of a turbulent free jet is invariant, which means that the length of the potential core in terms of nozzle diameter is substantially the same for all submerged jets.

FIG. 2 further depicts a downhole structure 212 (e.g., casing, inner wall of a tool string, etc.) upon which the fluid jet 110 impinges. The fluid jet 110 behaves as a free jet some distance away from the downhole structure 212. However, as the fluid jet 110 approaches the downhole structure 212, the average jet velocity diminishes sharply and the flow spreads around a stagnation region 210 in a more or less circular fashion, to form a wall jet, represented as 214 in FIG. 2. The downhole structure 212 is positioned a distance L away from the output end 206 of the nozzle 106. As noted above, the nozzle diameter D is a design parameter that is selected based on the value of the distance L. Effectively, D determines the value of $X_c$, and D can be selected such that L would be larger than $X_c$ (the length of the potential core of the fluid jet 110) such that the average velocity of the fluid that impinges upon the downhole structure 212 is lower than the velocity of the fluid jet in the potential core 202. In some embodiments, the nozzle diameter D is set so that the distance L is at least seven or eight times larger than the diameter (D) of the nozzle opening 208. The larger the L/D ratio, the lower the danger of erosion of the downhole structure 212. In fact, according to one embodiment, the ratio L/D is set to be twelve or greater.

Figure 3:
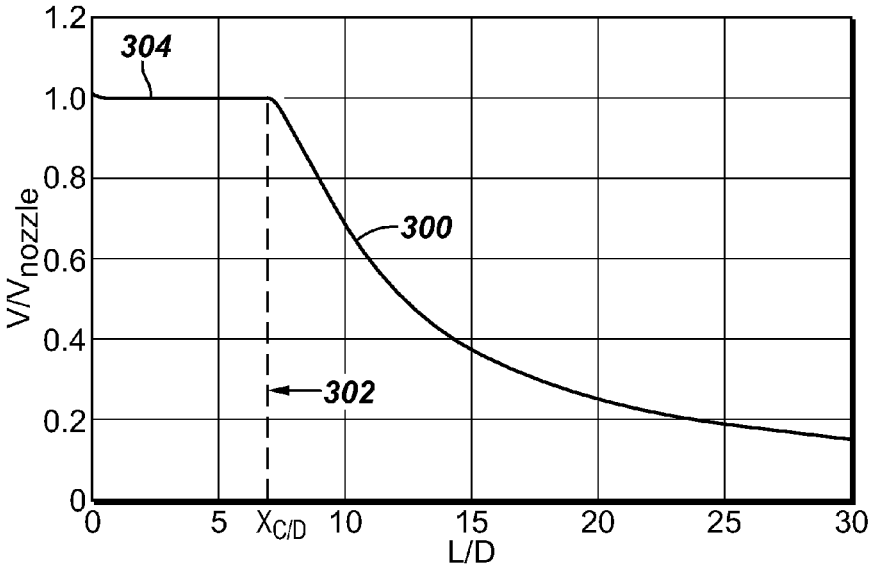
FIG. 3 is a graph depicting the relationship between fluid velocity along the jet center line and a ratio of a distance (between the valve nozzle and a downhole structure) to the diameter of the valve nozzle.

FIG. 3 shows a graph that has a curve 300 representing a ratio of the average velocity of fluid on the jet centerline to the nozzle velocity (fluid velocity at the output of the nozzle) as a function of the ratio L/D. A dashed vertical line 302 represents the point at which the length L is equal to the length of the potential core ($X_c$). Note that from the output end 206 of the nozzle 106 to the point at which the length L is equal to the length of the potential core, the fluid velocity of the fluid jet in the potential core stays relatively constant (304). However, after the length L crosses over $X_c$, the average fluid velocity of the fluid jet drops relatively rapidly. In fact, at X/D=12, the average fluid velocity is half of the fluid velocity in the potential core.

By setting the distance L properly, a shroud does not have to be provided around the module 108 of the tool string 104 that contains the nozzles 106. A shroud is a protective layer around the outside of the module 108 to protect a downhole structure such as the casing from damage due to erosion by fluid jets. By providing erosion protection without use of a shroud, tool string complexity and costs can be reduced. Note that provision of a shroud around the module 108 effectively reduces the distance L between the shroud and the nozzles 106 of the module 108, which can lead to increased erosion of the shroud. Moreover, bounce-back of fluids from a shroud to the module 108 can cause erosion of the outer wall of the module 108.

Figure 4:
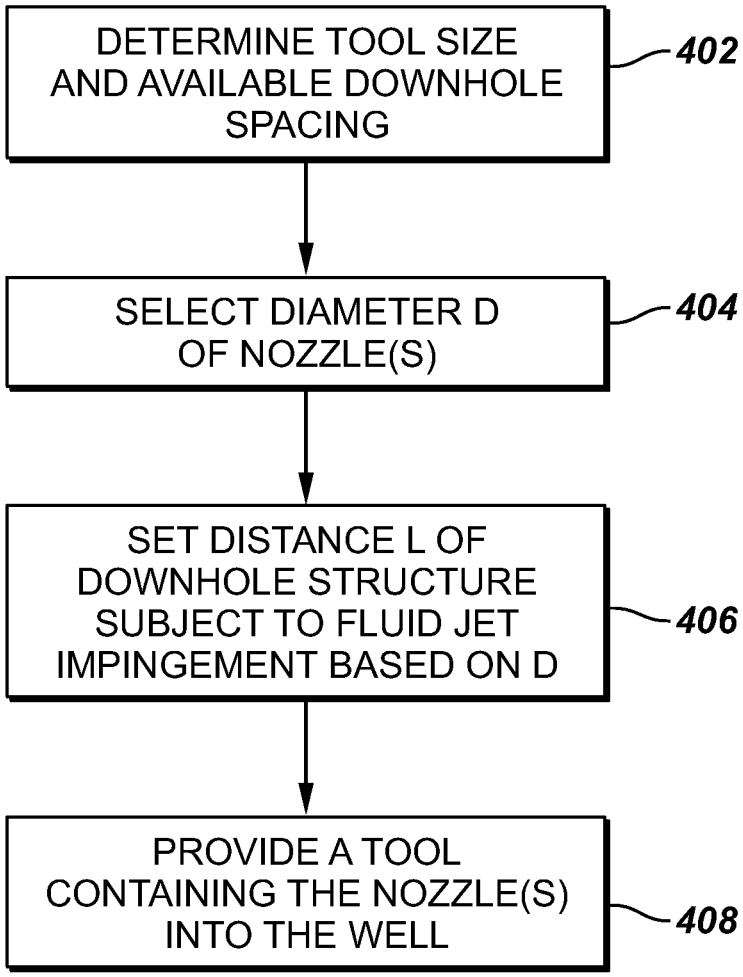
FIG. 4 is a flow diagram of a process of providing a completion arrangement that provides erosion control according to some embodiments.

FIG. 4 shows a flow diagram of a process according to some embodiments. First, the tool size and available downhole spacing is determined (at 402). The tool size refers to the size (e.g., outer diameter) of the tool that contains one or more valves with corresponding nozzles. The available downhole spacing includes the available spacing between the tool once deployed in the well and a downhole structure (e.g., casing) that is subject to impingement by fluid jets from the one or more nozzles of the tool. Based on the tool size and available downhole spacing, the diameter D of each nozzle is selected (at 404), and the distance L of the downhole structure subject to fluid jet impingement from each corresponding nozzle is set (at 406), where the value of L is set based on the value of the diameter D of the corresponding nozzle. The distance L is set to be greater than the length of the potential core of a fluid jet that exits the nozzle. Alternatively, instead of setting L based on D, it is noted that if downhole spacing is tight, then the nozzle diameter D can be set based on L (in other words, the nozzle opening size should be set lower to provide fluid jets having potential cores with shorter length) such that L can be greater than the potential core length.

Once the diameter D and distance L are set, the tool containing the one or more nozzles is provided (at 408) into the well, such as by running the tool into the well on tubing or on a carrier line such as a wireline or slickline. Once positioned in the well, the nozzles are positioned prescribed one or more distances (L) away from the downhole structure(s) that is (are) the subject of erosion protection according to some embodiments.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. An apparatus for use in a wellbore, comprising:

a module for deployment downhole in the wellbore and having a nozzle with an output to provide a jet of fluid, wherein the module further has a valve associated with the nozzle to control fluid flow through the nozzle;

a structure proximate the nozzle and positioned a set distance away from the output of the nozzle, wherein the set distance is greater than a length of a potential core of the jet of fluid; and wherein the nozzle has an opening of a particular diameter, and wherein the module has additional nozzles each also having the particular diameter, the particular diameter selected to enable the set distance of the structure from the output of each nozzle to be greater than the length of the potential core of the respective jet of fluid produced by each nozzle, and wherein the module has additional valves associated with the additional nozzles.

2. An apparatus for use in a wellbore, comprising:

a module for deployment downhole in the wellbore and having a nozzle with an output to provide a jet of fluid, wherein the module further has a valve associated with the nozzle to control fluid flow through the nozzle;

a structure proximate the nozzle and positioned a set distance away from the output of the nozzle, wherein the set distance is greater than a length of a potential core of the jet of fluid; and wherein the valve is a production valve to produce fluids from a reservoir surrounding the wellbore.

3. A method of providing a well tool having a nozzle, comprising:

determining a distance from an output of the nozzle to a downhole structure that is subject to erosion by a jet of fluid produced from the output of the nozzle when the well tool is deployed in a wellbore, wherein the nozzle is associated with a valve to control fluid flow through the nozzle, and wherein the nozzle and valve are part of the well tool deployed in the wellbore;

selecting a size of an opening of the nozzle based on the determined distance to cause an average velocity of the jet of fluid impinging upon the downhole structure to be less than a velocity of the jet of fluid in a potential core of the jet of fluid;

deploying the well tool into the wellbore; and after deploying the well tool into the wellbore, using the valve as a production valve to control production of fluids from a reservoir surrounding the wellbore.

4. An apparatus for use in a wellbore that has a downhole structure, comprising:

a valve for deployment in the wellbore and having a nozzle with an output to provide a jet of fluid in a direction toward the downhole structure, wherein the valve is to control fluid flow through the nozzle, wherein a diameter of the nozzle is selected such that a distance between the nozzle and the downhole structure is greater than a length of a potential core of the jet of fluid;

wherein the valve is a production valve to control production of fluids from a reservoir surrounding the wellbore.

* * * * *